United States Patent [19]

Chen

[11] Patent Number: 4,560,284

[45] Date of Patent: Dec. 24, 1985

[54] CONTINUOUS TYPE OF FLUID MIXING AND FEEDING DEVICE

[76] Inventor: Hwang C. Chen, 2nd Flr., No. 16, La. 282, Min Tzwu W. Rd., Taipei, Taiwan

[21] Appl. No.: 554,103

[22] Filed: Nov. 21, 1983

[51] Int. Cl.[4] ..... B01F 5/06

[52] U.S. Cl. ..... 366/336; 366/337; 366/338; 366/340

[58] Field of Search ..... 366/336, 337, 338, 339, 366/340, 341, 150, 152, 154, 160, 161, 165, 176

[56] References Cited

U.S. PATENT DOCUMENTS

| | | | |
|---|---|---|---|
| 2,835,481 | 5/1958 | Cox | 366/152 |
| 3,266,780 | 8/1966 | Waters | 366/340 |
| 3,701,619 | 10/1972 | Appeldoorn | 366/336 |
| 3,856,270 | 12/1974 | Hemker | 366/340 |
| 4,018,426 | 4/1977 | Mertz | 366/340 |
| 4,299,655 | 11/1981 | Skaugen | 366/336 |

*Primary Examiner*—Robert W. Jenkins
*Attorney, Agent, or Firm*—Glenn J. Perry

[57] ABSTRACT

The present invention is a continuous type of fluid mixing and feeding device; particularly, a batch fluid mixing and feeding device and an automatic and continuously conveying device are combined in order to mix and feed two or more than two kinds of fluids at a given temperature and a given viscosity, under controlled pressure. The mixing and feeding device comprises a first mixing means with rotary means, a pressure-varying mixer, and a multi-stage mixing means in a given number and being arranged in a suitable sequence. In this device, the fluid is processed through forward and reverse rotation, pressure-varying, and pushing repeatedly; fluids having different viscosity and particle size will thoroughly be pressed, cut, diverged, and mixed repeatedly during the feeding steps; then, a mixed fluid output at a constant temperature and constant pressure will be obtained continuously.

9 Claims, 8 Drawing Figures

SEC: B-B

SEC: A-A

CONTINUOUS TYPE OF FLUID MIXING AND FEEDING DEVICE

BACKGROUND OF THE INVENTION

Generally, the current mixing method for fluid is that two to three sets of agitators are used for a mixing operation on a batch-by-batch basis. First, the fluids to be mixed are poured into an agitating tank using proper measuring means. Once standard pre-agitating conditions (temperature, viscosity and liquid level) are obtained, an agitating motor with a constant HP is started to agitate until reaching the mixing standard required, such as the viscosity, color, etc.; then, the mixed fluid may be poured into another container for storage or directly fed to the production line. The main drawbacks of this agitator are:

1. Small processing volume and space consuming - Since it is batch-by-batch operation, each batch requires a great deal of time for processing, agitating, and conveying, the feeding volume per time unit becomes very small. Therefore, it is necessary to provide two or three sets of agitators, and each batch of fluid or material needs a considerably large space. The total agitating equipment takes a lot of factory space, and therefore the whole production system is affected.
2. No continuous feed—As a result of the batch-by-batch operation method, considerable time is needed to change the feeding pipes and to change the agitators; when changing, feeding is stopped. Since each agitator needs manpower and control instruments, it is deemed as being not economical in terms of operation, time, and equipment.

3. High HP required—The batch to be processed may rang from several hundreds of liters to several tons, using an agitating power of at least 10 HP; for instance, a volume of 300–700 liters at a viscosity of 4000 Redwood, may need 20 HP.

4. Inconsistent Quality—Under the batch-by-batch processing method, the agitator vane must be rather thick and strong, and using that kind of vane it is very difficult to achieve an even agitating and cutting result in the fluid, moreover, there is no control at all over the size of the fluid particles.
5. Large consumption of emulsifier—Since the quality stability is difficult to control, and the time between the agitating operation and the conveying operation is also not easy to control, the fluid is liable to re-condense and to gasify; therefore, the batch method requires a lot of emulsifier (interfacial agent) to maintain the fluid agitated and mixed at a given standard state.

SUMMARY OF THE INVENTION

The present mixing and feeding device was developed in order to improve the conventional agitating and mixing operation. The invention uses a small HP pump to continuously pump a suitable percentage of fluid at a given standard state to be compressed into a cylinder-shaped mixing device that has a very small cross-sectional area so as to have the fluid, under the feeding stage, thoroughly compressed, cut, diverged and mixed. By means of this mixing method, fluids having different viscosity and particles can be completely mixed in better quality without using a batch-by-batch mixing operation; further, this device can also decrease the production cost, processing space requirements and horse power requirement, and can provide a continuous feeding operation.

DETAILED DESCRIPTION

Figure 1:
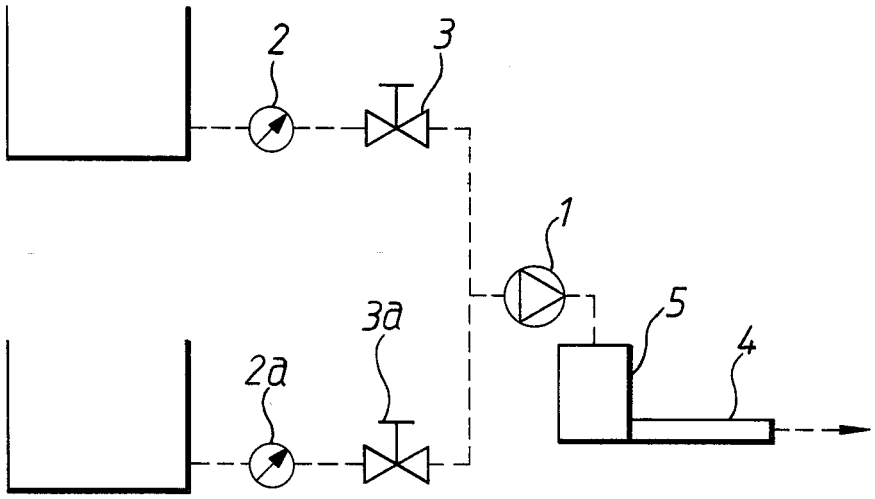
FIG. 1 is a flow chart of the mixing process of the present invention.

Referring to FIG. 1, there are shown the pumping and control steps before mixing the fluid, in which two or more than two kinds of liquid materials are pumped simultaneously with a pump 1; the liquid material can be maintained at a temperature of 5° C. higher than the normal temperature, and at a viscosity ranging from 10 to 300,000 pa (measured by a thermometer and a viscometer), i.e., keeping the liquid in normal state such as within the viscosity range, at a constant temperature, constant pressure, and a constant value, provides a stable output for the pump 1 operation. Therefore, between the pump 1 and the material feed barrel, a small diameter pipe may be used for conveying the fluid. On the conveying pipe of every feed barrel, a flow meter 2 and a regulating valve 3 may be installed to properly control the percentage of the various fluid materials flowing into the mixing and feeding device 4. The mixing percentage required depends on the quality requirement of the mixed fluid.

Since flowing fluid in the small diameter pipe can be regulated with the regulating valve 3, the maximum quantity pumped with the pump 1 at a given time unit will be equal to the total flowing quantity of all the conveying pipes; therefore, the batch quantity pumped is relatively small, and the power of the pump 1 in processing a quantity of 2500 l/hour may be less than two HP, which is a low consumption rate. The material may be fed into a precision grinding machine 5 before being pumped into the mixing and feeding device 4. The said grinding machine 5 is a machine using the known rotatively grinding method. If there are any solid particles in the flowing fluid, the grinding machine 5 will crush them into suitable fine particles before they are pumped into the mixing and feeding device 4.

Figure 2:
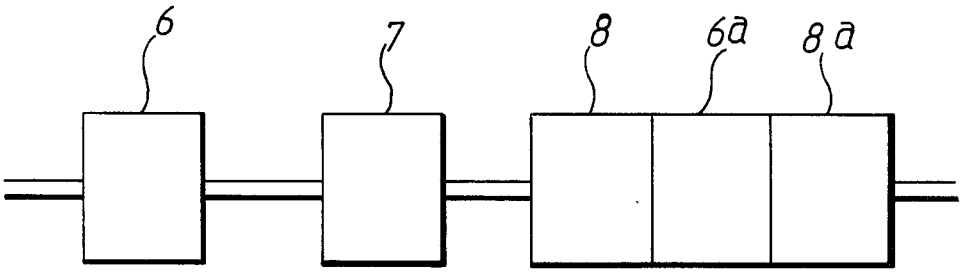
FIG. 2 is a fluid-mixing step block diagram of the mixing and feeding device of the present invention.

After two or more than two kinds of fluid materials are processed through the aforesaid steps and fed into the mixing and feeding device 4, they are passed through the first mixing unit 6, a pressure-varying mixer 7 and a multi-layer fluid mixer 8, which may be arranged in an appropriate sequence or in a duplicate sequence as shown in FIG. 2, i.e. in which the fluid will pass through the first mixing unit 6, the pressure-varying mixer 7 and the multi-stage fluid mixer 8; then, the fluid passes through an first mixing unit 6 and a multi-stage fluid mixer 8 for completely mixing before feeding into the production line. The aforesaid mixing sequence or device may be designed in accordance with the extent of the mixing difficulty of a given fluid; further, the input and output terminals of the various mixing means such as 6,7, and 8 should be designed with uniform specifications so as to facilitate the replacement during maintenance or repair. The steps and precision requirement of the various mixing means 6, 7, and 8 may be specially installed in accordance with the nature and condition of the fluid materials.

Figure 3:
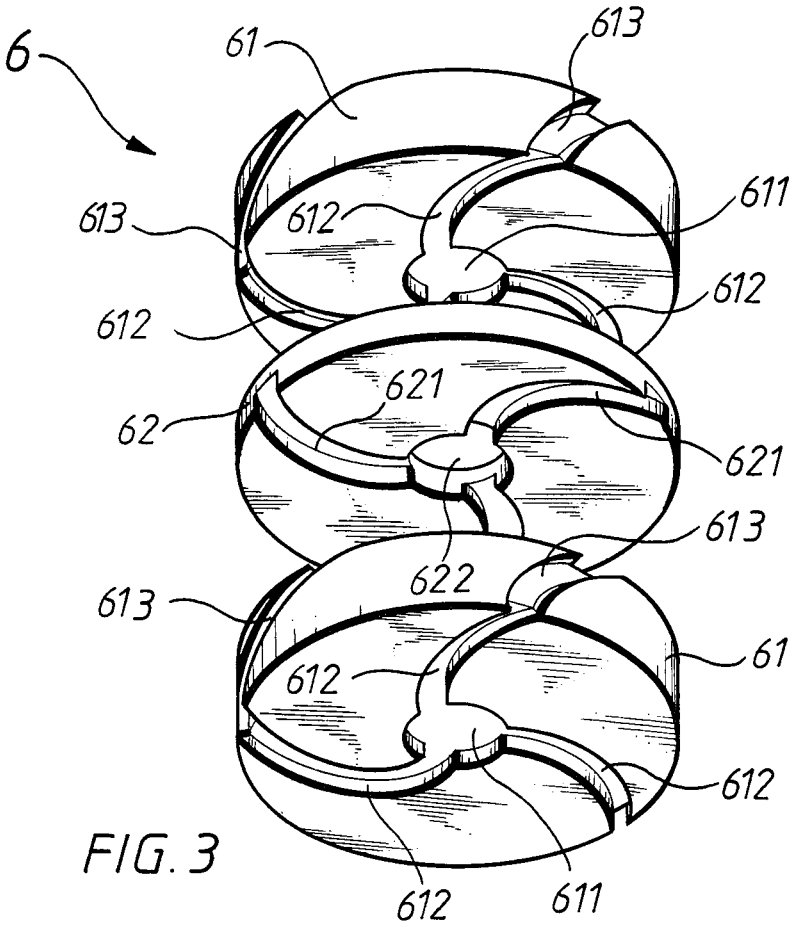
FIG. 3 is a perspective and exploded view of the inner parts of the first mixing unit in the mixing and feeding device of the present invention.
Figure 4:
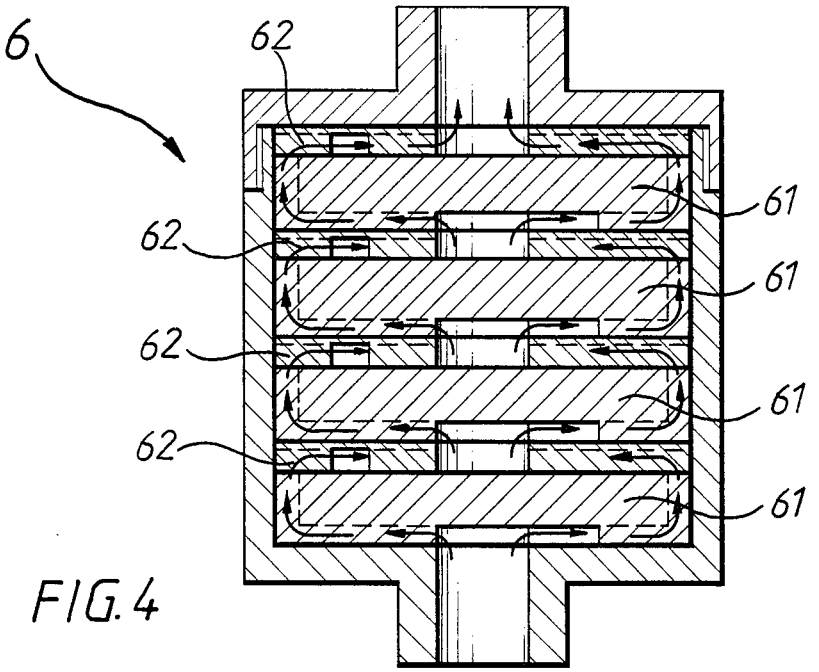
FIG. 4 is a sectional view of an embodiment of the first mixing unit of the present invention.

Referring to FIGS. 3 and 4, there are shown the detailed structures of the first mixing unit (alternate rotor) 6, which includes several sets of forward rotating guide disks 61 and reverse rotating guide disks 62 arranged one above the other. The forward rotating guide disk 61 is furnished, in its center, with a shallow round recess 611 having a diameter equal to that of the output and input pipes. From the shallow round recess 611, more than two forward rotating grooves 612 are furnished and extend to the edge of the disk 61 and the vertical surface of the disk, i.e. the column surface groove 613. The reverse rotating guide disk 62 is thinner than the forward rotating guide disk 61; the outer end of the reverse rotating groove 621 is exactly opposite the terminal of the column surface groove 613 on the forward rotating disk 61. The reverse rotating grooves 621 are gradually converged towards the center of the disk 62, and finally communicate with one another in a through fluid guide hole 622, of which the diameter is equal to that of the output and input pipes, and of the shallow round recess 611. The number of the grooves in the forward rotating groove 612, the reverse rotating groove 621, and the column surface groove 613 are all equal to one another; the total cross-sectional area of all the said grooves is equal to the cross-sectional area of the shallow round recess 611, the fluid guide hole 622, or the output and input pipes; for instance, if "Ao" stands for the total cross-sectional area of "N" forward rotating grooves 612; then, AoN=the cross-sectional area of the shallow round groove 611. The same rule may be applied to the column surface groove 613 and the reverse rotating groove 621. Upon the fluid being compressed, through the input pipe, into the first mixing unit the fluid will first be resisted by the shallow round recess 611 and then flow to the various forward rotating grooves 612 and the column surface grooves 613; then, the scattered fluid will flow into the reverse rotating grooves 621 and converge into the fluid guide hole 622. Again, the fluid will flow into a next forward rotating guide disk 61 for the same cycle of forward-/reverse rotating process as mentioned above.

The alternate rotating and flowing operation is indicated with arrows in FIG. 4. Since the total cross-sectional area of the rotating grooves has a certain relation to the input flowing quantity, a constant flowing pressure is maintained. The forward and reverse rotating grooves 612 and 621 of each set of the forward and reverse rotating guide disks 61 and 62 may be designed into different phase configuration. The number of sets may be more or less in accordance with the requirements of the particles, viscosity and pressure of the fluid.

Figure 5:
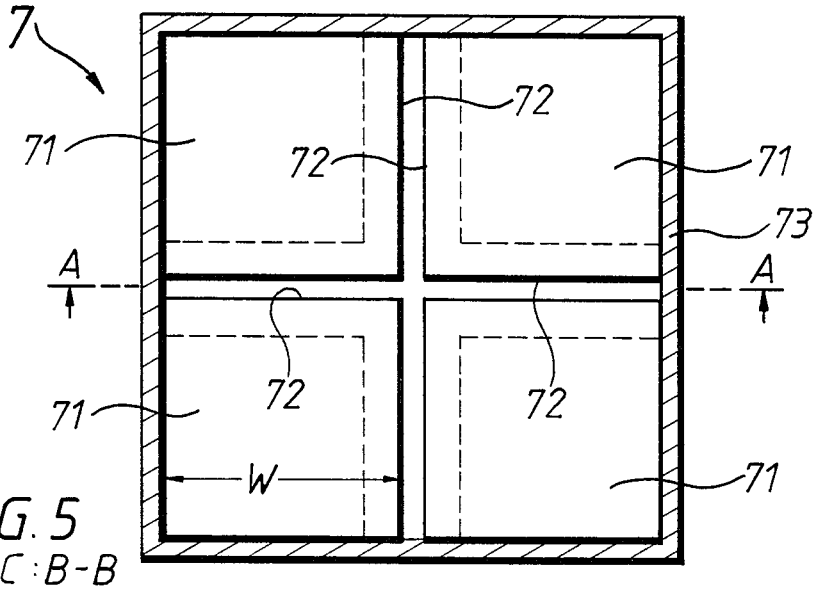
FIG. 5 is a cross-sectional view of the pressure-varying mixer of the present invention.
Figure 6:
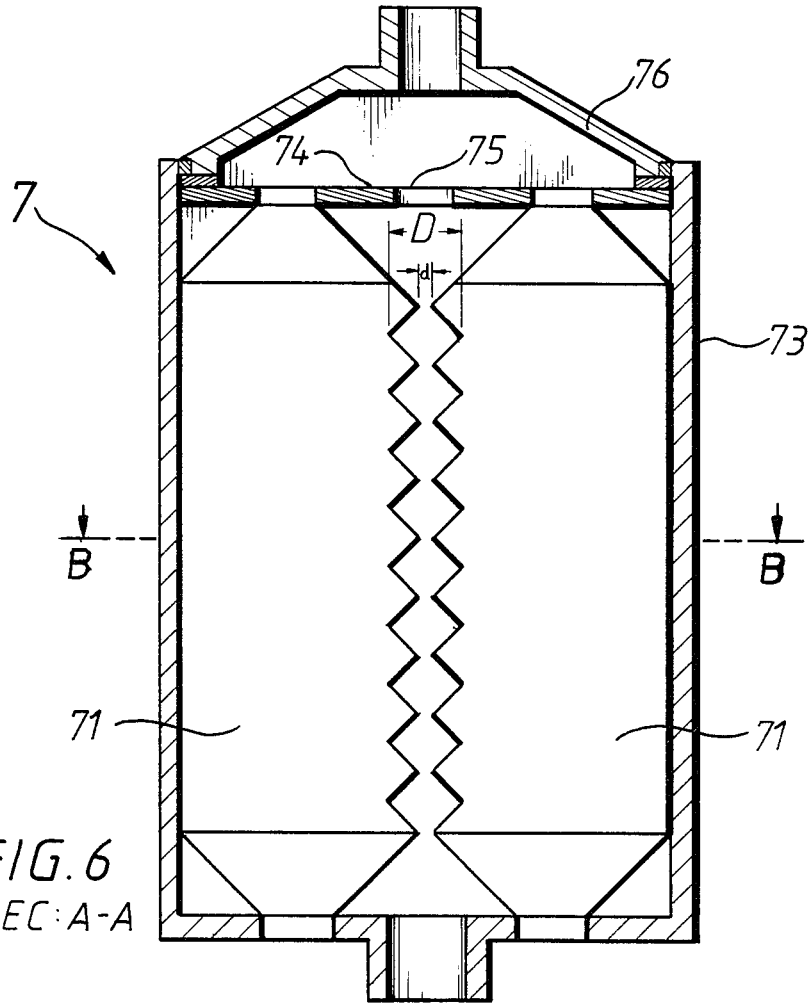
FIG. 6 is a sectional view of the pressure-varying mixer of the present invention.

Referring to FIGS. 5 and 6, there are shown the structures in different views of the pressure-varying mixer 7, which comprises two or four square columns 71 each having one row of linear parallel saw teeth 72, the outer body 73, and a positioning plate 74 which is used for arranging two or four square columns together with the linear saw teeth being opposite each other. The top and bottom ends of the aforesaid square column 71 are gradually reduced in a conical shape so as to be inserted into the outer body 73 and the positioning plate 74, and to have the parallel saw teeth 72 of the two square columns 71 maintained at a given space. If "d" stands for the space between the teeth 72 point, and "D" stands for the distance between the teeth base of two rows of parallel teeth 1 of four square columns, and "W" stands for the width of each said square column 71 as shown in FIG. 5, the four square columns 71 will be able to provide a minimum cross-sectional area for the fluid to pass, i.e., $A_2=4Wd+d^2$; the maximum cross-sectional area would be $A_3=4WD'D^2$. If "A" stands for the cross-sectional area of the output pipe of the pressure-varying mixer 7, and "A" also stands for the cross-sectional area of the guide hole 75 in the center of positioning plate 74, then $A_2<A<A_3$. Therefore, upon the fluid being compressed into the pressure-varying mixer 7, the pressure is first reduced; upon the fluid passing through the cross-sectional area of saw-tooth crest, the fluid pressure will immediately be increased to a level higher than the input pressure. Upon passing through the cross-sectional area of the saw-tooth root, the pressure again is reduced to a level under the original input pressure. The length and the number of saw teeth on the square column 71 are determined by the requirement in order to have the fluid pressure varied in suitable cycles to obtain a thorough mixing of the fluid particles by having them separated and converged repeatedly.

The best ratio between A and $A_2$ mentioned above according to inventor's repeated experiments using Bunker oil #6 at 35° C. under the viscosity ranging from 2u−5u is that $A_2=0.6$–$0.7$. The ratio of this design is completely dependent on the characteristics and quality of the fluid. Further, the fluid being processed with the pressure-varying means and flowing through the guide hole 75 can be converged via an arch-shaped cap 76 to flow through an output pipe the the original input pressure.

Figure 7:
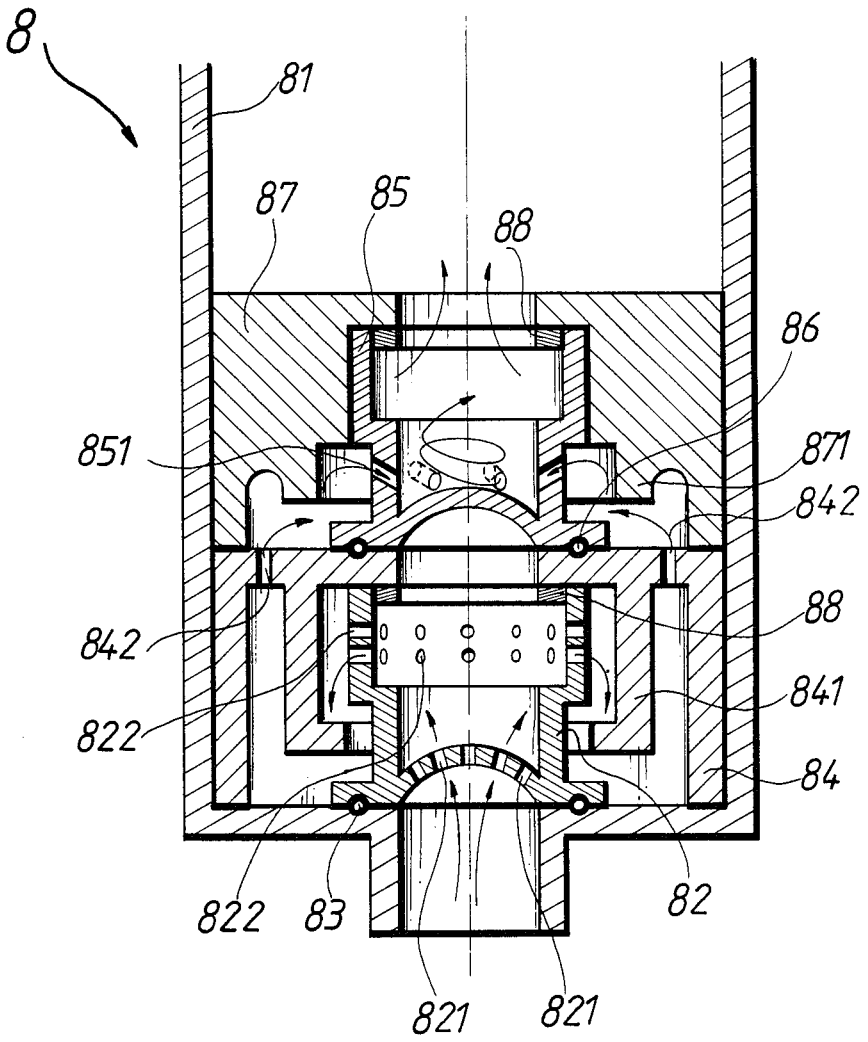
FIG. 7 is a partial sectional view of the multi-stage fluid mixer of the present invention.
Figure 8:
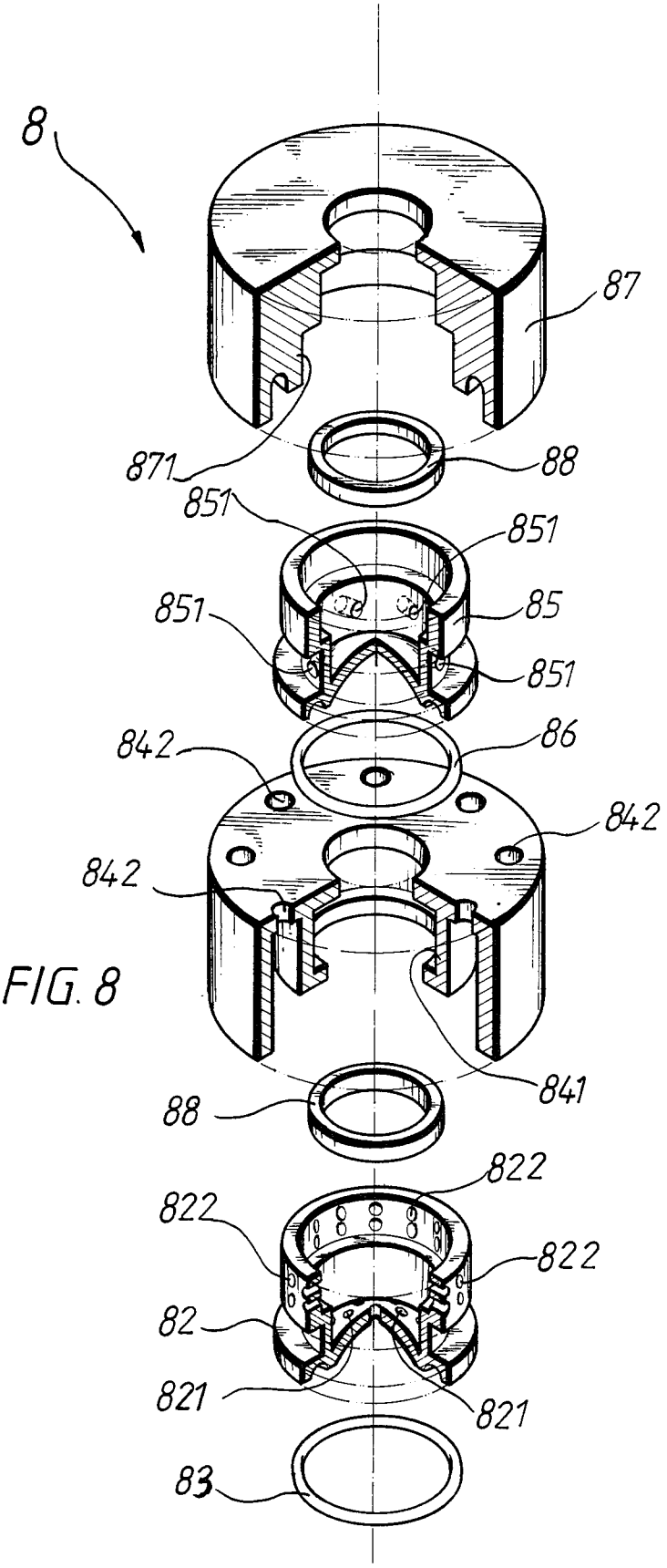
FIG. 8 is a perspective and exploded view of the multi-stage fluid mixer of the present invention.

The multi-stage fluid mixer 8 as shown in FIGS. 7 and 8 comprises two stages of fluid-guiding elements as one set, more than two sets may be put one above the other inside the body 81.

Referring to FIG. 8, there is shown an exploded view of one set of the fluid-guiding elements, in which the lowest stage is a scattering ring 82 closely sealed with a gasket ring 83 to the input opening of the body 81. The scattering ring 82 is inserted into the lower ring seat 84. The ring 82 is closely contacted with the seat 84 by means of a collar 88. At the bottom of the scattering ring 82, there is furnished an arch-shaped converging cap with "n" small holes 821. On the upper half portion of the scattering ring 82, having larger diameter there are furnished "n" through holes 822. Between the outer wall of the lower ring seat 84 and the scattering ring 82, there is a separating cylinder 841. On the top side of the separating cylinder 841 and the outer wall of the lower ring seat 84, there are furnished "n" guide holes 842. In this mixer, the upper ring seat 87 is also provided with a rotating and converging cylinder 85, which is attached to the top of the lower ring seat 84 with a pad ring 86. The rotating and converging cylinder 85 is also attached to the center of the upper ring seat 87 with a collar 88, and the top of the cylinder 85 is also furnished with an arch-shaped converging cap without small holes. In the middle portion of the cylinder 85, there are furnished "n" coil holes 851, which are slanted towards the center in a coil shape. Further, the upper ring seat 87 also has a short separating ring 871, but the upper ring seat 87 has a solid top.

In operation as shown in FIG. 7, the multi-layer fluid mixer 8 as will allow the fluid to enter into the arch-shaped converging cap from the input pipe; then, the fluid is passed through the small holes 821, the through holes 822, and passed around the separating cylinder 841, and is then passed through the guide holes 842, around the separating ring 871, and through the rotating holes 851 of the middle of the rotating and converging cylinder 85; finally, the fluid flows upwards into the bottom of the next set of scattering rings 82 for another similar mixing cycle.

The pressure-varying guide flowing steps of the aforesaid multi-stage fluid mixer 8 are also done by varying the cross-sectional area. If "$a_1$" stands for the cross-sectional area of the small hole 821, "$a_2$" stands for the cross-sectional area of the through hole 822, "$a_3$" stands for that of the guide hole 842, and "$a_4$" stands for that of the rotating hole 851, and if the inner minimum cross-sectional areas of the scattering ring 82 and the rotating and converging cylinder 85 are all equal to the cross-sectional area "A" of the input/output pipe, without regarding the separating cylinder 841 and the separating ring 871 since they have no relation to the pressure-varying function, but merely the separating function; then, the total cross-sectional area of the small holes 821 is $\Sigma a_1 n$;

the total cross-sectional area of the through holes 822 is $\Sigma a_2 n$;

the total cross-sectional area of the guide holes is $\Sigma a_3 n$;

the total cross-sectional area of the rotating holes 851 is $\Sigma a_4 n$.

In accordance with the quality and the viscosity of the fluid mixed, the diameter of the small holes 821 and the through holes 822 should have the best size (under approx. 2.5 mm), and $$A > \Sigma a_1 n \cdot \Sigma a_2 n \cdot \Sigma a_3 n \cdot \Sigma a_4 n, \text{ among which}$$

$$\Sigma a_1 n = \Sigma a_2 n = \Sigma a_3 n = \Sigma a_4 n, \text{ or}$$

$$\Sigma a_1 n \Sigma a_2 n \Sigma a_3 n \Sigma a_4 n.$$

In accordance with the flowing processes through the said channel; the fluid pressure will promptly be lowered after passing each of said channels, and the pressure will be lifted to a pre-determined level after passing the next channel; then, the fluid will be subject to the changing states of scattering or whirling, separating, and pressure-reducing. In the various fluid channels, the size of the fluid particles is in inverse proportion to the pressure of fluid; the pressure of the fluid is in direct proportion to the cross-sectional area of the fluid channel; the cross-sectional area of the fluid channel is in inverse proportion to the number processing stages; the size of the fluid particles is in inverse proportion to the quantity processed. Therefore, the smaller the fluid particles become, the more the pressure necessary, and the flowing quantity of the cross-sectional of a channel will become smaller. The more stages the various mixers have, the more processing quantity a time unit will have. If the fluid flow rate, the size of the fluid particles, and the cross-sectional area of the fluid channels is a constant, the change of pressure will depend on the cross-sectional area. In the present invention, if the cross-sectional area of the input pipe is "A", the total cross-sectional area of the forward and reverse rotating grooves of the first mixing unit 6 should be $\Sigma aon = 0.7$ A; the total space of saw-tooth crest in the pressure-varying mixer 7 should be $\Sigma A_2 n = 0.6$ A; and the total cross-sectional area of the small holes 821 of the multi-stage fluid mixer 8, $\Sigma a_1 n$, the total cross-sectional area of the through holes 822 of the multi-layer fluid mixer 8, $\Sigma a_2 n$, the total cross-sectional area of the guide holes 842, $\Sigma a_3 n$, and the total cross-sectional area of the rotating holes 851 of the multi-layer fluid mixer 8, $\Sigma a_4 n$ should all be $\Sigma 0.5$ A, which stands for the best design. If the fluid is under the condition of 2–5 u viscosity and at a temperature of 35° C., the relation between the flow rate and the pressure of a unit cross-sectional area may be shown with the following table:

TABLE I

| Flow Rate | Pressure of Cross-sectional Area |
|---|---|
| 500 Liter/hr. | 7 Kg/cm$^2$ |
| 1000 " | 10 " |
| 2000 " | 18 " |
| 3000 " | 25 " |
| 5000 " | 35 " |
| 10000 " | 50 " |

Briefly, the present invention by means of the first mixing unit 6, the pressure-varying mixer 7, and the multi-stage fluid mixer 8 can mix completely a fluid with very small cross-sectional area mixed completely; simultaneously, the pump 1 will continuously pump a given percentage of fluid to feed into the mixing and feeding device 4; this is superior to the interrupted batch-by-batch feeding method when the volume of fluids required is large.

The advantages of the present invention are:

1. Small horsepower requirement:

Since the processing volume is determined in accordance with the flow rate of a given unit of cross-sectional area, the horsepower required by the pump is small. If the processing volumn is 3000 lb./hr., only three HP (horsepower is) needed, while the conventional and known batch-by-batch processing method may need 20 HP.

2. Continuos feed:

The known batch-by-batch processing method is a way to feed the fluid is an interrupted manner, of which the feeding volume is usually two tons per hour, while the present invention can continuously feed over 40 tons per hour, which is suitable for automatic production line systems because of saving the time and cost of interrupted operation.

3. Stable and accurate quality control

The output material of the present invention is processed under a constant flow rate through the multi-stage cutting, and mixing steps, the same processing time, distance, and channels; therefore, the quality is very consistent.

4. Small emulsifier requirement (interfacial agent):

Since the fluid is processed continuously from the input to the output terminal without having a still state, it has higher mobility, and therefore needs little emulsifier.

5. Low manufacturing Cost:

Since the fluid is continuously fed with a small HP pump, not much emulsifier is required, and the present invention requires very small spare to be set up; therefore, it can operate more of the time without reducing its process efficiency and economy.

I claim:

1. A device for the continuous mixing and feeding of fluids comprising:

two fluid sources, each containing one of the fluids to be mixed, conduits for receiving fluids from said sources;

a primary pipe for converging fluids from said conduits;

a first means, coupled to said primary pipe, for mixing fluids including rotary means, for scattering and converging the fluids received from said primary pipe;

a first pipe for receiving fluids from said first mixing means;

means for varying the pressure of fluids communicated from said first pipe;

a second pipe for receiving fluids from said pressure varying means;

multi-stage means for scattering, whirling, separating and varying the pressure of the fluids communicated from said second pipe; and a third pipe for receiving fluids from said multi-stage means.

2. A device as claimed in claim 1, further comprising a pump on said primary pipe, a flow meter and a regulating valve on each of said conduits, for feeding a given percentage of fluid into said conduit.

3. A device as claimed in claim 1 wherein said first means for mixing fluids, said means for varying the pressure of fluids, and said multi-stage means are arranged in a suitable sequence and are present in suitable numbers.

4. A device as in claim 1 wherein said first means for mixing fluids includes at least one forward rotating guide disk and one reverse rotating guide disk; said forward rotating guide disk has in its center, a shallow round recess having a diameter equal to that of said primary pipe and said first pipe; and from said shallow round recess, more than two forward rotating grooves extend to the outer edge of said forward rotating guide disk forming a column surface groove at said outer edge; said reverse rotating guide disk has the same number of reverse rotating grooves as said forward rotating guide disk which are opposite said column surface grooves, and said reverse rotating grooves gradually converge to a fluid guide hole.

5. A device as in claim 4 wherein in said first means for mixing fluids, the cross-sectional areas of both said shallow round recess and said fluid guide hole are equal to those of said primary pipe and said first pipe; and the total cross-sectional area of said forward and reverse rotating grooves and said column surface grooves on said forward rotating guide disk, is equal to or slightly less than the cross-sectional areas of said primary pipe and said first pipe.

6. A device as in claim 4 wherein in said first means for mixing fluids, said forward and reverse rotating grooves in said forward and reverse rotating guide disks are arranged at different phase angles and in an overlapping manner.

7. A device as in claim 1 wherein said means for varying the pressure of fluids includes an outer body, at least two rectangular columns having parallel saw teeth between two opposite faces; the two rows of said saw teeth are arranged opposite each other in a tooth crest to too crest and tooth root to tooth root manner, and the total cross-sectional area between opposite saw-tooth crest is less than that of said first pipe and said second pipe, while the cross-sectional area between opposite saw-tooth roots is larger than that of said first pipe and said second pipe.

8. A device as in claim 7 wherein in said rectangular column, the side contacted with said outer body is a flat surface, while the side opposite to the other rectangular column has several saw teeth; and both ends of said columns are fixed in position by means of said outer body and a positioning plate.

9. A device as in claim 12 wherein said multi-stage means includes a first fluid guiding element and a second fluid-guiding element; each pair of said first and second fluid guiding elements includes a ring for scattering fluid with an upper half portion, a gasket ring, a collar, a lower ring seat with an outer wall, a cylinder for rotating and converging fluid, a cylinder for separating fluid, an upper ring seat, an exterior wall, a separating ring, and an exterior body in which:

said ring for scattering fluid is attached to an input opening of said exterior body by means of said gasket ring, and at the bottom of said ring for scattering fluid there is an arch-shaped cap for converging fluid with several small holes; and on said upper half portion of said ring for scattering fluid, there are a number of holes, and said ring for scattering fluid is attached to said lower ring seat with said collar; said lower ring seat having an outer diameter equal to the inner diameter of said exterior body, is fitted together with said ring for scattering fluid, said cylinder for separating fluid is located between said ring for scattering fluid and said outer wall of said lower ring seat, and located on the top between said cylinder for separating fluid and said outer wall, there are a number of holes;

said cylinder for rotating and converging fluid is attached to an edge of a center hole of said lower ring seat with a ring, and is attached to said upper ring seat with said collar, and at the bottom of said cylinder for rotating and converging fluid, there is a second arch-shaped cap, and on a wall of a middle portion of said cylinder for rotating and converging fluid there are a number of holes slanting towards the center of said cylinder for rotating and converging fluid; and said upper ring seat having an outer diameter equal to the inner diameter of said exterior body, and a top solid piece; and between said exterior wall of said upper ring seat and said cylinder for rotating and converging fluid, there is said separating ring.

* * * * *